US007779963B2

(12) United States Patent
Muto

(10) Patent No.: US 7,779,963 B2
(45) Date of Patent: Aug. 24, 2010

(54) EXHAUST SYSTEM FOR MOTORCYCLE

(75) Inventor: Yoshihiro Muto, Shizuoka (JP)

(73) Assignee: Yamaha Hatsudoki Kabushiki Kaisha, Iwata-Shi (JP)

( * ) Notice: Subject to any disclaimer, the term of this patent is extended or adjusted under 35 U.S.C. 154(b) by 0 days.

(21) Appl. No.: 11/927,340

(22) Filed: Oct. 29, 2007

(65) Prior Publication Data

US 2008/0110693 A1 May 15, 2008

(30) Foreign Application Priority Data

Oct. 30, 2006 (JP) ..... 2006-294140

(51) Int. Cl.
*F01N 1/00* (2006.01)

(52) U.S. Cl. ..... 181/252; 181/250; 181/212; 181/228; 181/227; 181/282; 180/296

(58) Field of Classification Search ..... 181/252, 181/250, 227, 228, 282; D12/194; 180/296, 180/309, 68.3, 89.2
See application file for complete search history.

(56) References Cited

U.S. PATENT DOCUMENTS

| | | | | | |
|---|---|---|---|---|---|
| 2,158,030 | A | * | 5/1939 | Latulippe | 181/268 |
| 3,072,214 | A | * | 1/1963 | Deremer | 181/250 |
| 3,114,432 | A | * | 12/1963 | Ludlow et al. | 181/227 |
| 3,739,873 | A | * | 6/1973 | Shaughnessy | 181/228 |
| 4,132,285 | A | * | 1/1979 | Milde et al. | 181/258 |
| 4,234,054 | A | * | 11/1980 | Chapin | 181/252 |
| RE31,989 | E | * | 9/1985 | Nomura et al. | 180/219 |
| 4,598,790 | A | * | 7/1986 | Uesugi et al. | 181/252 |
| 4,760,894 | A | * | 8/1988 | Harwood et al. | 181/282 |
| 4,819,428 | A | * | 4/1989 | Ciccarone | 60/323 |
| 4,913,260 | A | * | 4/1990 | Fallon | 181/254 |
| 5,033,581 | A | * | 7/1991 | Feuling | 181/257 |
| 5,055,274 | A | * | 10/1991 | Abbott | 422/171 |
| 5,280,143 | A | * | 1/1994 | Kakuta | 181/250 |
| D351,579 | S | * | 10/1994 | Simpson | D12/194 |
| 5,869,793 | A | * | 2/1999 | Berger et al. | 181/256 |
| 5,969,299 | A | * | 10/1999 | Yamaguchi et al. | 181/227 |
| D460,726 | S | * | 7/2002 | Campbell et al. | D12/194 |
| 6,546,722 | B2 | * | 4/2003 | Sagara et al. | 60/324 |
| 6,595,318 | B2 | * | 7/2003 | Ebinger et al. | 181/227 |

(Continued)

FOREIGN PATENT DOCUMENTS

EP 421724 A1 * 4/1991

(Continued)

*Primary Examiner*—Jeffrey Donels
*Assistant Examiner*—Forrest M Phillips
(74) *Attorney, Agent, or Firm*—Rabin & Berdo, PC

(57) ABSTRACT

A motorcycle having a tail pipe formed from a pair of branch pipes that branch from a main pipe and that ensures a sound absorbing effect. A muffler has a casing that surrounds a rear section of an exhaust pipe, and a sound absorbing material that is filled between the casing and the rear section of the exhaust pipe. The rear section of the exhaust pipe includes a main pipe that is connected to the exhaust pipe and that extends to the rear, and first and second branch pipes that are connected to and branch from the main pipe and extend to the rear. A cross sectional area of the casing, when viewed from an exhaust gas flow direction becomes larger as the casing extends toward the branch pipe side.

19 Claims, 12 Drawing Sheets

U.S. PATENT DOCUMENTS

| | | | | |
|---|---|---|---|---|
| 6,648,099 | B2 * | 11/2003 | Dooley | 181/228 |
| 6,675,933 | B2 * | 1/2004 | Yamaguchi | 181/227 |
| 6,702,062 | B2 * | 3/2004 | Kusabiraki et al. | 181/240 |
| 6,868,939 | B2 * | 3/2005 | Ziehl | 181/256 |
| 6,913,111 | B2 * | 7/2005 | Schorn et al. | 181/243 |
| 6,988,576 | B2 * | 1/2006 | Suzuki | 180/190 |
| D528,488 | S * | 9/2006 | Webb | D12/194 |
| 7,318,497 | B2 * | 1/2008 | Okunosono | 181/227 |
| 7,320,378 | B2 * | 1/2008 | Inaoka et al. | 180/225 |
| 7,409,824 | B2 * | 8/2008 | Inaoka et al. | 60/324 |
| 7,624,842 | B2 * | 12/2009 | Mizutani | 181/249 |
| 2002/0134614 | A1 * | 9/2002 | Chen | 181/252 |
| 2003/0079938 | A1 * | 5/2003 | Yamaguchi | 181/227 |
| 2004/0089500 | A1 * | 5/2004 | Lewis | 181/249 |
| 2004/0163887 | A1 * | 8/2004 | Ziehl | 181/256 |
| 2005/0082113 | A1 * | 4/2005 | Okunosono | 181/227 |
| 2006/0201742 | A1 * | 9/2006 | Terashima et al. | 181/227 |
| 2007/0181360 | A1 * | 8/2007 | Nakayama | 180/309 |
| 2008/0110155 | A1 * | 5/2008 | Harada | 60/276 |
| 2008/0190685 | A1 * | 8/2008 | Nishino | 180/296 |

FOREIGN PATENT DOCUMENTS

| | | | |
|---|---|---|---|
| EP | 1347155 | | 9/2003 |
| FR | 2583819 | | 12/1986 |
| JP | 57052612 | A * | 3/1982 |
| JP | 62165522 | A * | 7/1987 |
| JP | 62191611 | A * | 8/1987 |
| JP | 01290915 | A * | 11/1989 |
| JP | 05001534 | A * | 1/1993 |
| JP | 05-075422 | | 10/1993 |
| JP | 2001-073758 | | 3/2001 |

* cited by examiner

EXHAUST SYSTEM FOR MOTORCYCLE

RELATED APPLICATIONS

This application claims the benefit of priority under 35 USC 119 of Japanese patent application nos. 2006-294140, filed on Oct. 30, 2006, which application is hereby incorporated by reference in its entirety.

BACKGROUND OF THE INVENTION

1. Field of the Invention

The present invention relates to an improved exhaust system for a motorcycle having an engine, an exhaust pipe that is connected to the engine, and a muffler that is connected to the exhaust pipe.

2. Description of Related Art

Conventional motorcycle exhaust systems have an exhaust pipe connected to an engine and a muffler connected to the exhaust pipe. Some types of mufflers have a casing that surrounds a tail pipe that forms a rear section of the exhaust pipe. In addition, sound absorbing material is filled between the casing and the tail pipe.

In order to improve the sound absorbing effect of the muffler, the tail pipe may be lengthened as much as possible. The tail pipe disposed inside the casing has a main pipe and a pair of branch pipes that branch from and are contiguous with the main pipe (for example, refer to JP-UM-A-5-75422).

It is conceivable that an even better sound absorbing effect could be achieved in the muffler by filling sound absorbing material between the casing and the pair of branch pipes that branch from the main pipe and extends to the rear. However, the volume of the space formed between the casing and the branch pipes may be smaller than the volume of the space formed in the main pipe section, and thus the amount of sound absorbing material that can be filled is limited. As a result, there is a problem that the sound absorbing effect generated by the sound absorbing material is inadequate.

SUMMARY OF THE INVENTION

The invention has been devised in light of these circumstances and provides an exhaust system for a motorcycle that achieves adequate sound absorbing effect by ensuring an adequate filled amount of sound absorbing material in a tail pipe with a pair of branch pipes branching from a main pipe.

The invention is a motorcycle provided with an engine, an exhaust pipe connected to the engine and a muffler connected to the exhaust pipe. The muffler includes a casing that surrounds a rear section of the exhaust pipe, and sound absorbing material that is filled between the casing and the rear section of the exhaust pipe. The rear section of the exhaust pipe includes a main pipe that is connected to the exhaust pipe and that extends to the rear, and first and second branch pipes that are connected to and branch from the main pipe and extend to the rear. The casing is formed such that, when viewed from an exhaust gas flow direction, a cross sectional area of the casing becomes larger as the casing extends toward the branch pipe side.

According to the motorcycle of the invention, the rear section of the exhaust pipe including the main pipe, and the first and second branch pipes is disposed in the casing that is formed such that the cross sectional area thereof increases as the casing extends toward the branch pipe side. As a result, the volume of the area between the casing and the branch pipe section can be increased as compared with a case where the casing is a straight pipe. To the extent that the area is larger, it is possible to ensure an adequate filled amount of the sound absorbing material, and thus sound absorbing effect is improved.

Other features and advantages of the invention will be apparent from the following detailed description, taken in conjunction with the accompanying drawings which illustrate, by way of example, various features of embodiments of the invention.

DETAILED DESCRIPTION OF THE INVENTION

Figure 1:
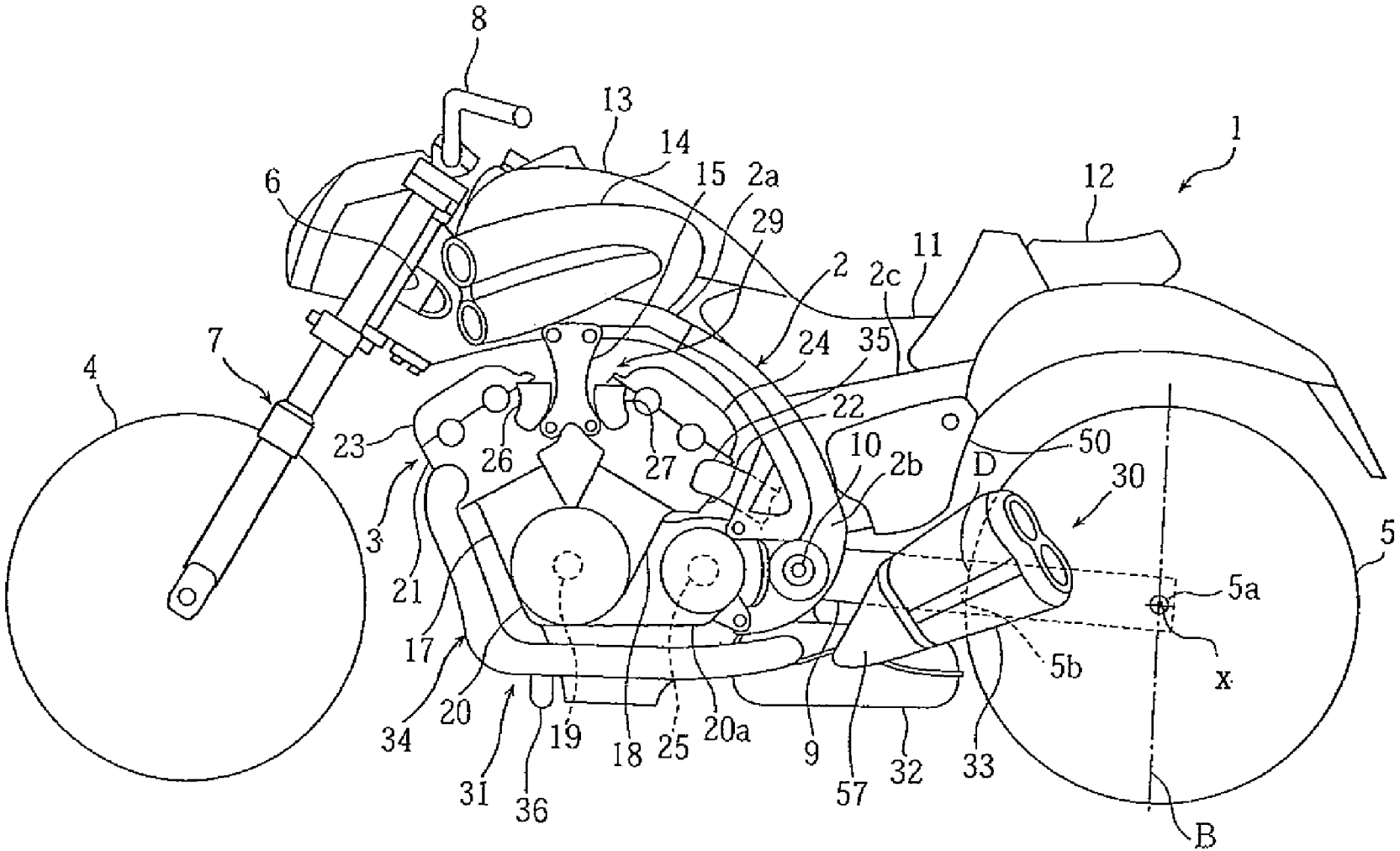
FIG. 1 is a side view of a motorcycle that is provided with an exhaust system according to an embodiment of the invention.
Figure 2:
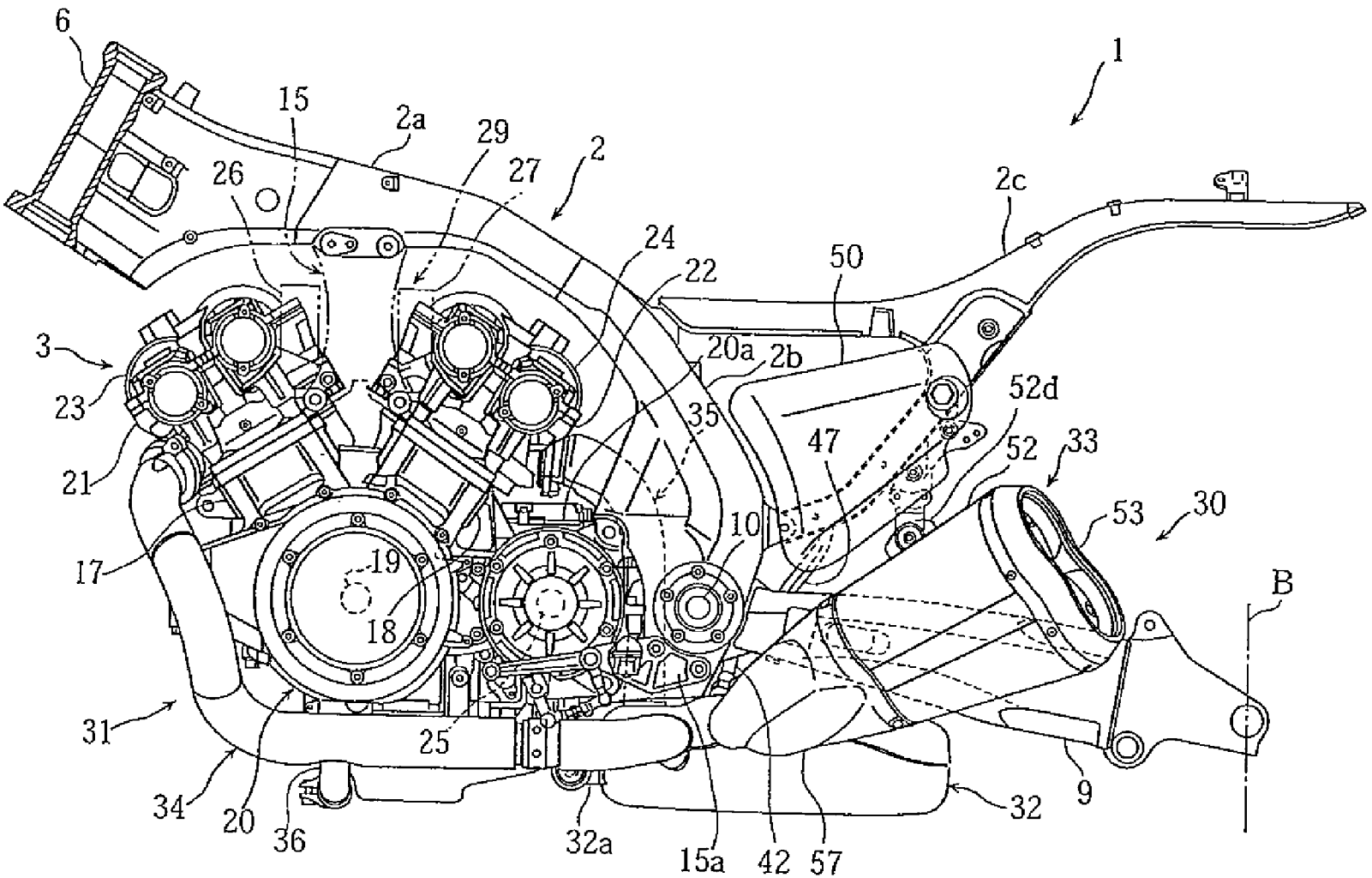
FIG. 2 is a side view of an engine, to which the exhaust system is connected, mounted to a vehicle body frame.
Figure 3:
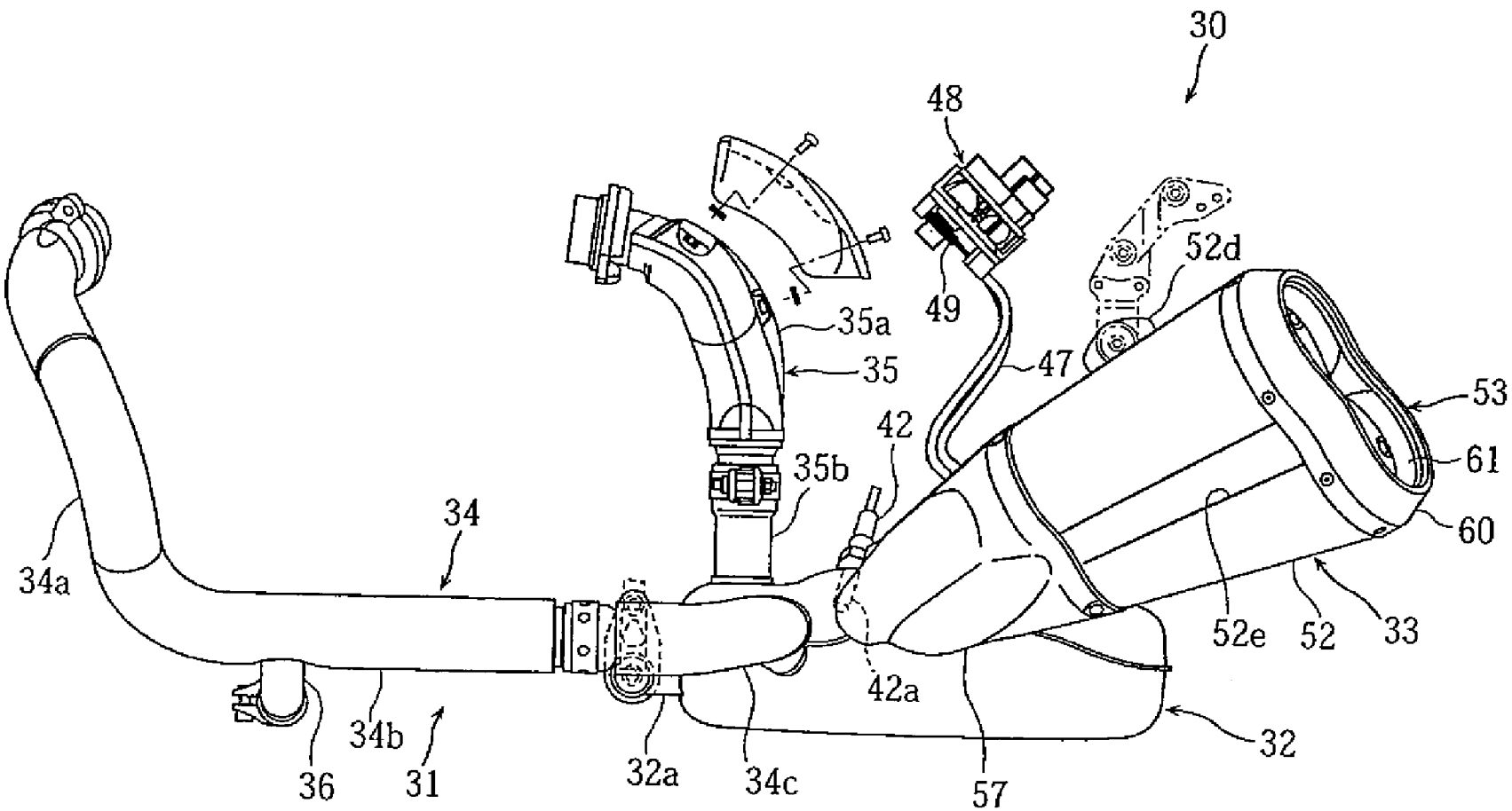
FIG. 3 is a side view of the exhaust system.
Figure 4:
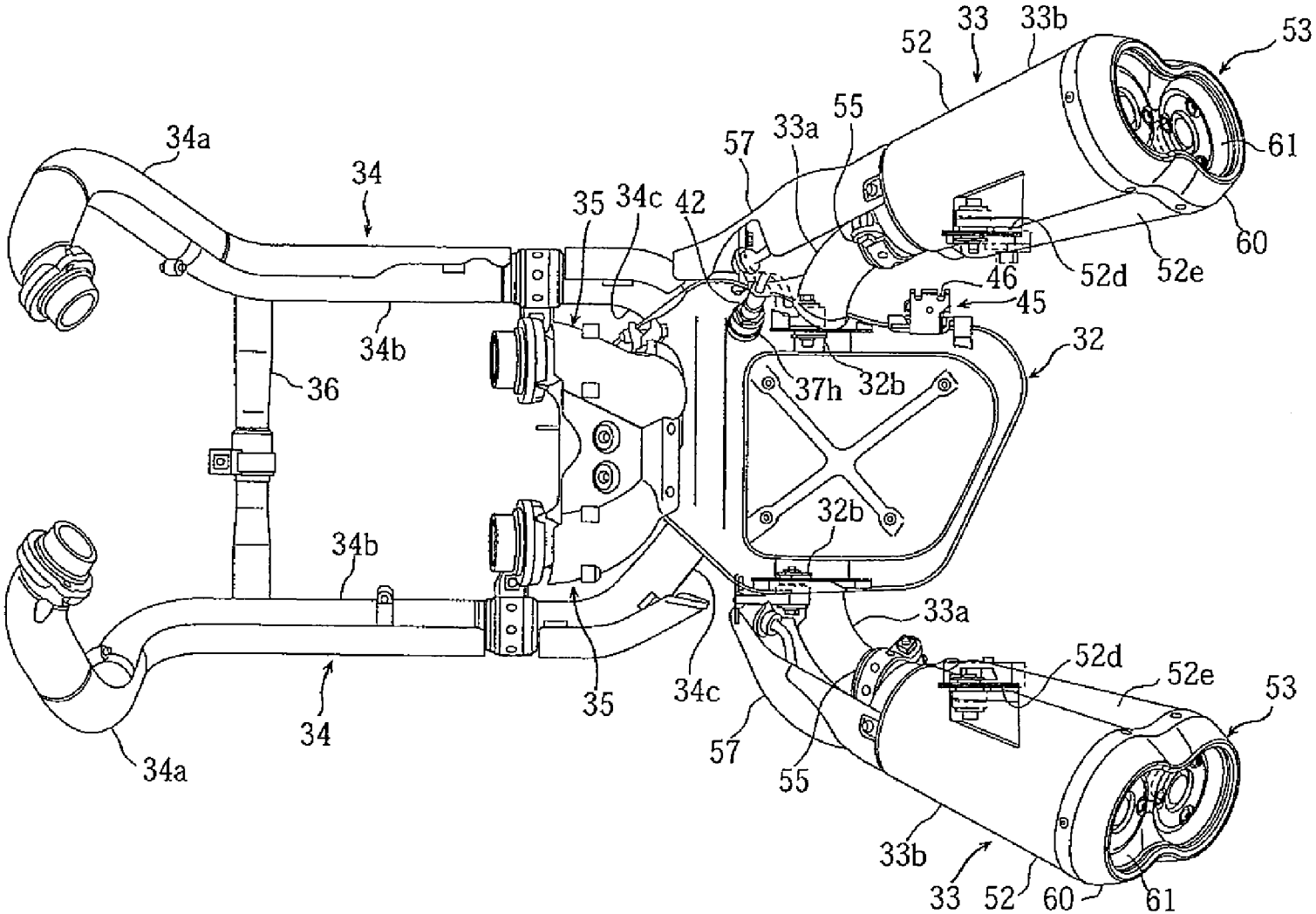
FIG. 4 is a plan view of the exhaust system.
Figure 5:
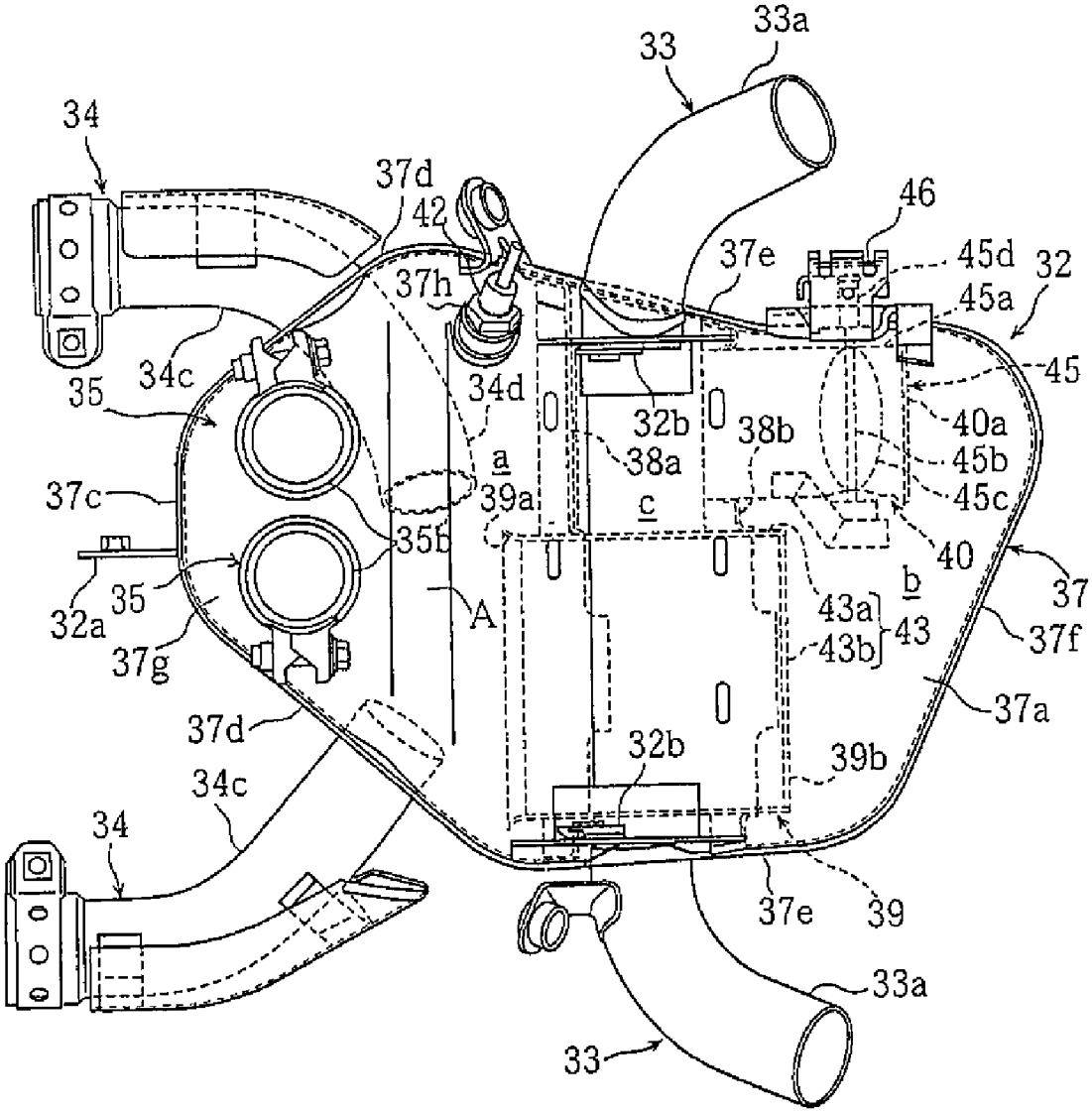
FIG. 5 is a plan view of an exhaust gas chamber of the exhaust system.
Figure 6:
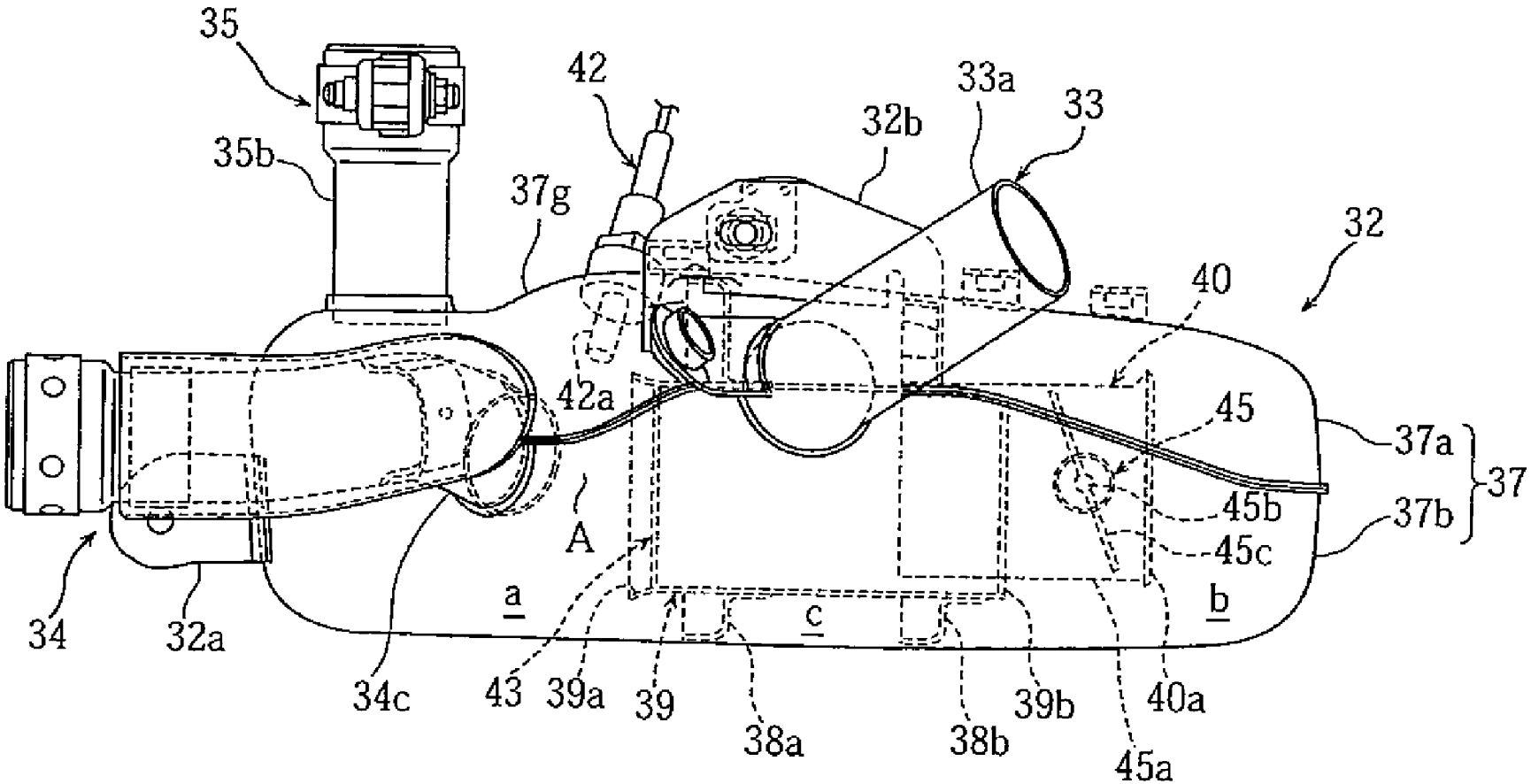
FIG. 6 is a side view of the exhaust gas chamber.

An embodiment of the invention is now described with reference to the appended drawings.

FIGS. 1-12 illustrate a motorcycle according to an embodiment of the invention. The terms front and rear, and left and right as used in this description indicate the front and rear and the left and right directions as viewed from a rider seated on a seat.

In the figures, 1 motorcycle 1 includes a twin spar vehicle body frame 2, an engine 3 that is mounted on vehicle body frame 2, and a front wheel 4 and a rear wheel 5 that are disposed at the front and rear of vehicle body frame 2.

Vehicle body frame 2 includes a head pipe 6 that is disposed at the front end of vehicle body frame 2; left and right main frames 2*a* that extend diagonally downward toward the rear while expanding outwards to the left and right from head pipe 6; left and right rear frames 2*b* that are contiguous with main frames 2*a* and that extend and curve downwards; and left and right seat rails 2*c* that extend diagonally upward to the rear from rear frames 2*b*.

A front fork 7 is turnably supported by head pipe 6 so as to be steered to the left and right. Front wheel 4 is rotatably supported by a lower end section of front fork 7, and a steering handle 8 is fixed to an upper end section of front fork 7.

A front end section of a rear arm 9 is pivotably supported via a pivot shaft 10 at a lower end section of left and right rear frames 2*b* so that rear arm 9 can swing upward and downward. Rear wheel 5 is pivotably supported by a rear end section of rear arm 9.

A straddle type main seat 11, and a straddle type tandem seat 12 that is positioned to the rear side of main seat 11, are mounted on left and right seat rails 2*c*. A tank cover 13, which is an exterior part, is disposed to the front side of main seat 11.

Engine 3 is a four stroke, four cylinder V-type engine that has left and right front side cylinders and left and right rear side cylinders that are disposed to form V-shaped banks. An engine upper section is supported by and suspended from left and right suspension brackets 15, 15 that are fixed to left and right main frames 2*a*. An engine rear wall is supported in a suspended manner by a suspension bracket 15*a* fixed to rear frames 2*b*.

In engine 3, a crank case 20 that houses a crank shaft 19 is connected to lower mating surfaces of front and rear cylinder blocks 17, 18 that form the V shaped banks. Upper mating surfaces of front and rear cylinder blocks 17, 18 are connected to front and rear cylinder heads 21, 22, and front and rear head covers 23, 24 are attached to front and rear cylinder heads 21, 22.

A transmission case 20*a* that houses a change gear mechanism is integrally connected with a rear side of crank case 20. Upper and lower walls of transmission case 20*a* are fixed by tightened bolts to rear frames 2*b*. Note that, 25 is an engine force output shaft.

An intake system 29 of engine 3 is provided with left and right front side and rear side intake pipes 26, 27, a throttle body, and a shared air cleaner. Left and right front side and rear side intake pipes 26, 27 are connected to a V shaped bank inside wall of front and rear cylinder heads 21, 22 so as to communicate with left and right front and rear intake ports. The throttle body is connected to left and right front side and rear side intake pipes 26, 27, and the shared air cleaner communicates with the throttle body.

The air cleaner is disposed beneath tank cover 13 between left and right main frames 2*a*, and left and right front side and rear side intake pipes 26, 27 extend generally perpendicularly upward from the V shape bank inside wall. In addition, left and right intake ducts 14, 14 that supply air to engine 3 are disposed to the left and right sides of tank cover 13. Left and right intake ducts 14 communicate with the air cleaner.

An exhaust system 30 of engine 3 includes four exhaust pipes 31 connected to engine 3, a single exhaust gas chamber 32 connected to exhaust pipe 31, and left and right mufflers 33, 33 connected to exhaust gas chamber 32. More specifically, exhaust system 30 has the following structure.

Exhaust pipe 31 includes left and right lateral exhaust pipes 34, 34 (engine side exhaust pipes), left and right vertical exhaust pipes (engine side exhaust pipes) 35, 35) downstream side exhaust pipes 33*a*, 33*a*, and tail pipes 51, 51. Left and right lateral exhaust pipes 34, 34 are connected so as to communicate with left and right front exhaust ports that open in a V shaped bank outside wall (front side wall) of front cylinder head 21. Left and right vertical exhaust pipes 35, 35 are connected so as to communicate with left and right rear exhaust ports that open in a V shaped outside wall (rear side wall) of cylinder head 22. Downstream side exhaust pipes 33*a*, 33*a* are connected to exhaust gas chamber 32, and tail pipes 51, 51 are connected to downstream side exhaust pipes 33*a*, 33*a*.

Left and right lateral exhaust pipes 34 include a downward slanting section 34*a*) a horizontal section 34*b*, and a horizontal curved section 34*c*. Downward slanting section 34*a* protrudes outwards toward the vehicle width direction outer side from cylinder head 21 while extending downwards. Horizontal section 34*b* extends generally linearly to the rear from a lower end of slanting section 34*a* along a lower side of crank case 20. Horizontal curved section 34*c* curves and extends in the vehicle width direction inner side from a rear end of horizontal section 34*b*. The pair of left and right horizontal sections 34*b* are connected and communicate with each other via a communication pipe 36 that extends in the vehicle width direction.

Left and right vertical exhaust pipes 35 include a vertical curved section 35*a*, and a perpendicular section 35*b*. Vertical curved section 35*a* curves and extends downwards to the rear side of transmission case 20*a* from cylinder head 22. Perpendicular section 35*b* is contiguous with vertical curved section 35*a* and extends downwards in a generally linear manner.

Exhaust gas chamber 32 is disposed between transmission case 20*a* of engine 3 and rear wheel 5, and below rear arm 9 including pivot shaft 10. Exhaust gas chamber 32 has a front flange 32*a* that protrudes outwards at a front end of exhaust gas chamber 32, and left and right flanges 32*b*, 32*b* that protrude upwards at left and right side edge sections of an upper wall of exhaust gas chamber 32. Front flange 32*a* is attached to crank case 20, and left and right flanges 32*b*, 32*b* are attached to rear frame 2*b* via a bracket.

Exhaust gas chamber 32 includes a chamber body 37, first, second and third expansion chambers a, b and c, a first communicating passage 39, and a second communicating passage 40. Chamber body 37 is a sealed box that is formed by joining respective outer periphery edge sections of an upper member 37*a* and a lower member 37*b*. First, second and third expansion chambers a, b and c are defined by first and second partition walls 38*a*, 38*b* and extend in the front-rear direction inside of chamber body 37. First communication passage 39 communicates between first expansion chamber a and second expansion chamber b. Second communicating passage 40 communicates between second expansion chamber b and third expansion chamber c.

Expansion chambers a, b and c are arranged from the front side in the order of first expansion chamber a, third expansion chamber c, second expansion chamber b. When viewed from the flow direction of exhaust gas, second expansion chamber b is positioned between first expansion chamber a to which left and right lateral exhaust pipes 34 and left and right vertical exhaust pipes 35 are connected, and third expansion chamber c to which left and right mufflers 33 are connected.

The volume of first expansion chamber a is larger than the volume of second and the third expansion chambers b, c, and the volume of second expansion chamber b is larger than the volume of third expansion chamber c.

Chamber body 37, when viewed from above, has a generally hexagonal shape, and includes a front end wall 37*c*; left and right front slanting walls 37*d*, 37*d* that extend diagonally rearwards while expanding to the outside from front end wall 37*c*; left and right side walls 37*e*, 37*e* that extend to the rear from the left and right front slanting walls 37*d*; and a rear wall 37*f* that extends in the vehicle width direction to connect between respective rear ends of left and right side walls 37*e*.

Horizontal curved sections 34*c*, 34*c* of left and right lateral exhaust pipes 34 are connected to left and right front slanting walls 37*d* of chamber body 37 so as to communicate with first expansion chamber a. As a result, exhaust gas flowing through left and right lateral exhaust pipes 34 flows in to first expansion chamber a from the outside in the vehicle width direction inside toward the inside in the vehicle width direction.

Right lateral exhaust pipe 34 includes an extending section 34*d* that is contiguous with horizontal curved section 34*c* and extends towards a central portion within first expansion chamber a. Extending section 34*d* is positioned so as to open in first expansion chamber a to the rear side of left and right vertical exhaust pipes 35. The opening of extending section 34*d* is in a central portion in the vehicle width direction of both exhaust pipes 35.

Perpendicular sections 35*b*, 35*b* of left and right vertical exhaust pipes 35, 35 are disposed in a line in the vehicle width direction and are connected in the vicinity of front end wall 37*c* of chamber body 37 so as to communicate with first expansion chamber a. Accordingly, exhaust gas flowing through left and right vertical exhaust pipes 35 flows within first expansion chamber a from the upper side in the upward-downward direction toward the downward side in the upward-downward direction.

A boss 37*h* is formed in a vehicle width direction inside end portion of an upper wall 37*g* of chamber body 37 so as to communicate with first expansion chamber a. A detection member 42*a* of an oxygen concentration detection sensor 42 is inserted in boss 37*h* so as to be positioned within first expansion chamber a. Oxygen concentration detection sensor 42 is surrounded by chamber body 37, left and right rear frames 2*b*, pivot shaft 10, and rear arm 9, and is thereby inhibited from being damaged by external forces.

Oxygen concentration detection sensor 42 is disposed at a position inside first expansion chamber a that is away from a merging portion A of left and right lateral exhaust pipes 34 and left and right vertical exhaust pipes 35. More specifically, extending section 34*d* is disposed such that exhaust gas is led away from oxygen concentration detection sensor 42. In addition, the structure is configured such that exhaust gas from each exhaust pipe is mixed together, and the mixed gas is brought into contact with detection member 42*a* of oxygen concentration detection sensor 42.

First communicating passage 39 passes through first and second partition walls 38*a*, 38*b* that form third expansion chamber c, and communicates with first expansion chamber a and second expansion chamber b. First communicating passage 39, when viewed from above, is disposed at the opposite side of chamber body 37 from oxygen concentration detection sensor 42, and an exhaust gas inflow port 39*a* of first communication passage 39 is disposed in the vicinity of exhaust gas merging portion A of first expansion chamber a.

A catalyst 43 is disposed in first communication passage 39. Catalyst 43 has a honeycomb structure catalyst body 43*b* that purifies exhaust gas disposed inside a metal tubular body 43*a* that forms communicating passage 39.

Figure 7:
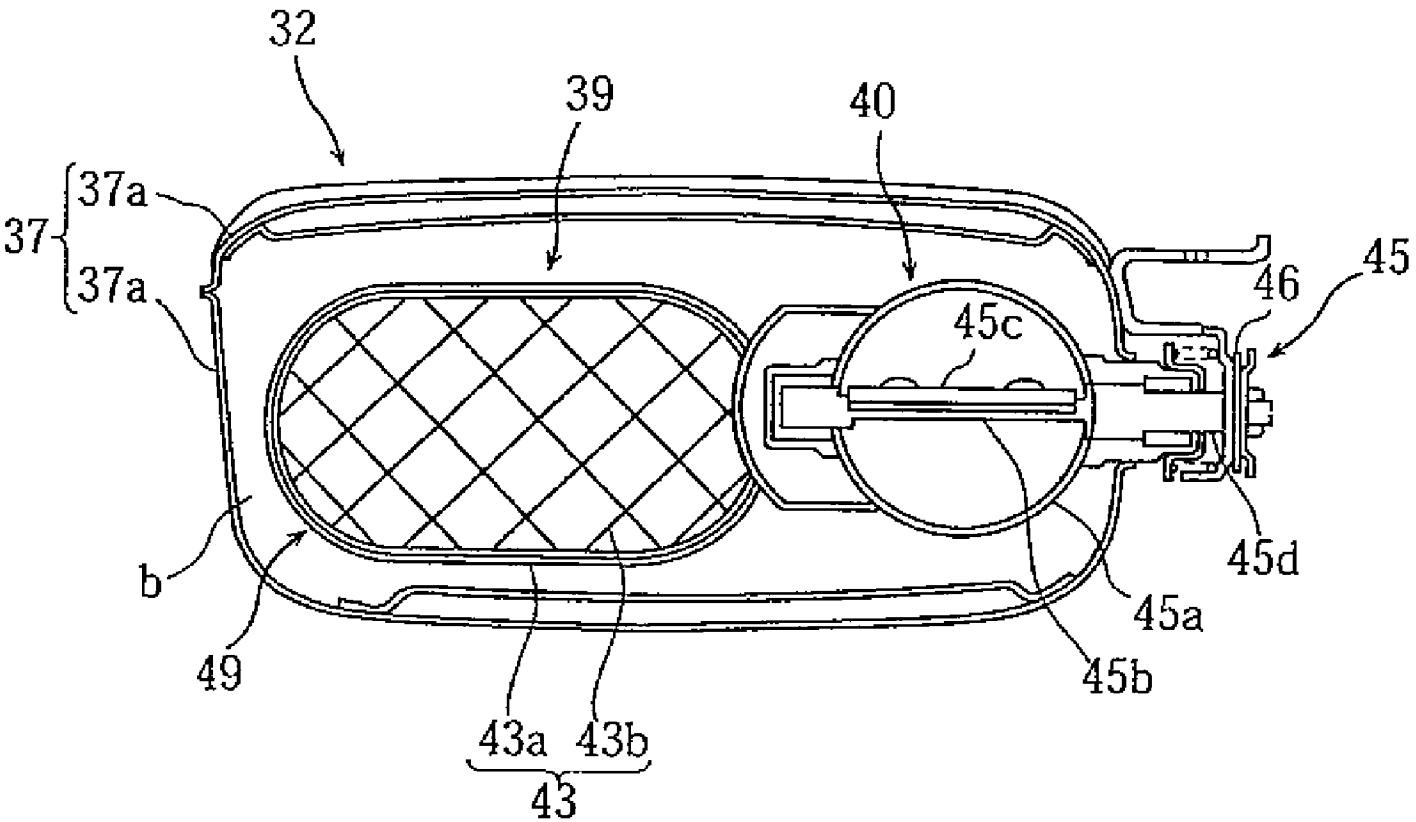
FIG. 7 is a cross sectional rear view of the exhaust gas chamber.
Figure 8:
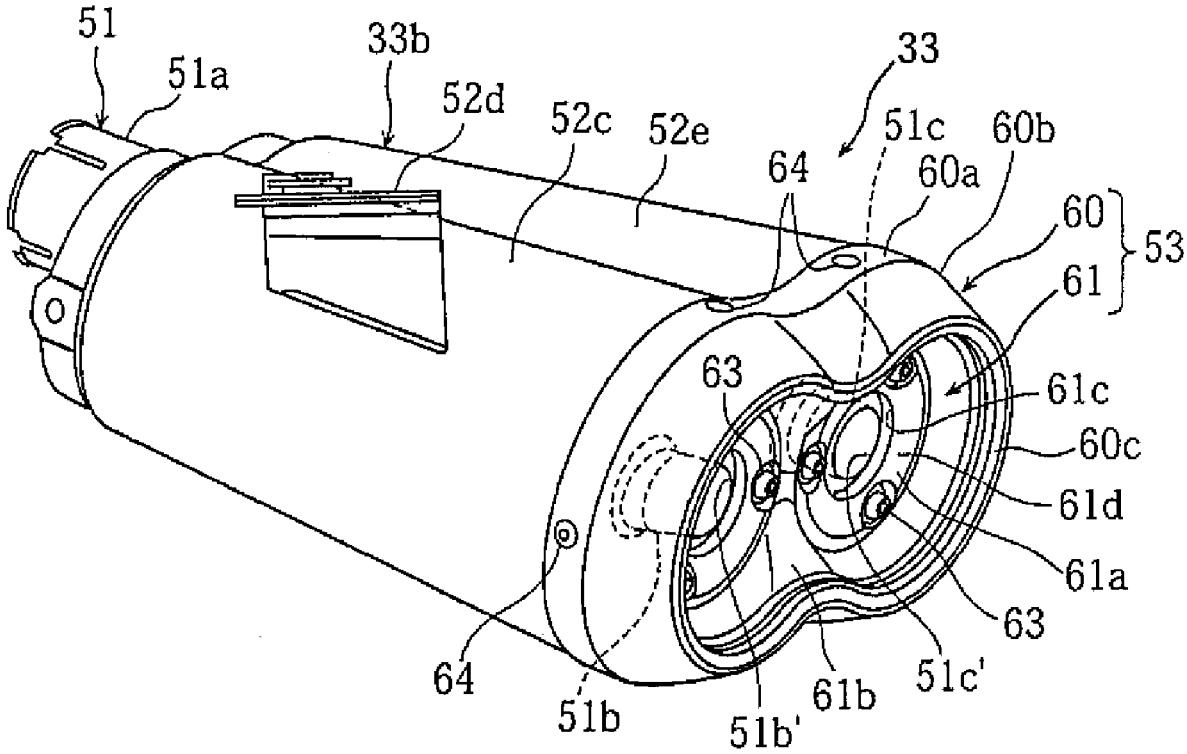
FIG. 8 is a plan view of a muffler of the exhaust system.
Figure 9:
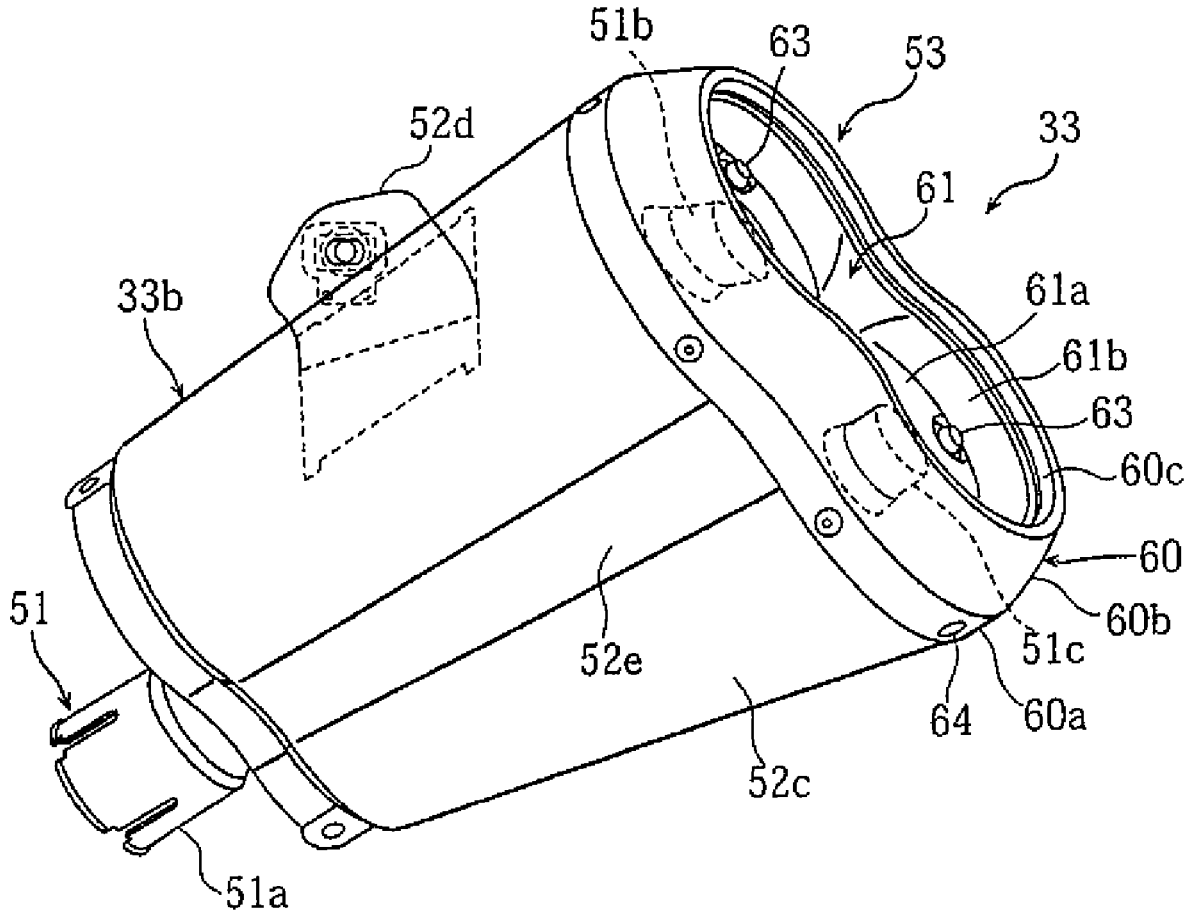
FIG. 9 is a side view of the muffler.

Catalyst 43 has an elliptical shape when viewed in a cross section, and is disposed such that the long axis of the elliptical shape extends in the vehicle width direction (refer to FIG. 7).

Second communicating passage 40 passes through second partition wall 38*b* and connects second expansion chamber b and third expansion chamber c. Further, second communicating passage 40 is disposed in the vicinity of right side wall 37*e* of chamber body 37. Second communicating passage 40 is disposed in alignment with first communication passage 39 to the right side thereof, and exhaust gas inflow port 40*a* of second communicating passage 40 is disposed at a position that is offset in the vehicle width direction from an exhaust gas outflow port 39*b* of first communication passage 39.

Exhaust gas from each cylinder passes along left and right lateral exhaust pipes 34 and left and right vertical exhaust pipes 35, and flows in to first expansion chamber a of exhaust gas chamber 32. The exhaust gas, which merges together in first expansion chamber a, flows in to second expansion chamber b via catalyst 43 of first communication passage 39. The exhaust gas then passes from second expansion chamber b to second communicating passage 40, and flows in to third expansion chamber c. Then, the exhaust gas flows from third expansion chamber c through left and right mufflers 33 and is exhausted to the outside.

A variable passage area valve 45 is disposed in second communicating passage 40 and can adjust the passage area of communicating passage 40.

Variable passage area valve 45 includes a communicating pipe 45*a*, a valve shaft 45*b*, and a valve plate 45*c*. Communicating pipe 45*a* has a tubular shape and forms second communicating passage 40. Valve shaft 45*b* passes through communicating pipe 45*a* in the vehicle width direction, and valve plate 45*c* is fixed to valve shaft 45*b* so as to be disposed within communicating pipe 45*a*.

Valve shaft 45*b* extends in the vehicle width direction, and a right end section passes through right side wall 37*e* of chamber body 37 and protrudes in the outward direction. A driven pulley 46 is fitted to a protruding portion 45*d* of valve shaft 45*b*. Driven pulley 46 is connected to a drive pulley 49 that is fitted to a rotating shaft of a drive motor 48 via a cable 47. Drive motor 48 is disposed inside a side cover 50 at the lower side of seat rails 2*c*.

Variable passage area valve 45 is controlled to open and close by a controller that detects an engine operation state based on engine speed, engine load and the like. When the engine operation state is in a low speed region, the controller controls variable passage area valve 45 to close, and when the engine operation state is in a middle or high speed region, the controller controls variable passage area valve 45 to open.

Left and right mufflers 33 include muffler bodies 33*b*, 33*b* that are attachably-detachably connected to downstream side exhaust pipes 33*a*, 33*a* that are joined to left and right side walls 37*e*, 37*e* of exhaust gas chamber 32 so as to communicate with third expansion chamber c.

Left and right mufflers 33, as shown in FIG. 1, are disposed further to the front than a vertical line B that passes through a centre x of a rotating shaft 5*a* of rear wheel 5. In addition, left and right mufflers 33 are disposed such that respective front-rear direction centres D thereof are positioned in the vicinity of a front edge 5*b* of rear wheel 5.

Left and right mufflers 33 extend diagonally upward to the rear from exhaust gas chamber 32, and also protrude toward the outside in the vehicle width direction.

Left and right muffler bodies 33*b* have a casing 52 and a tail cap 53. Casing 52 surrounds an outer periphery of tail pipes 51 connected to downstream side exhaust pipes 33*a*. Tail cap 53 is attached so as to cover the outer side of a rear end wall 52*a* of casing 52.

Tail pipes 51 include: a single main pipe 51*a* that is connected and fixed in an attachable-detachable manner to downstream side exhaust pipes 33*a* via a fastening member 55; and first and second branch pipes 51*b*, 51*c* that are contiguous with main pipe 51*a* and fork upward and downward while extending to the rear. First and second branch pipes 51*b*, 51*c* have a slightly smaller diameter than main pipe 51*a*.

Figure 10:
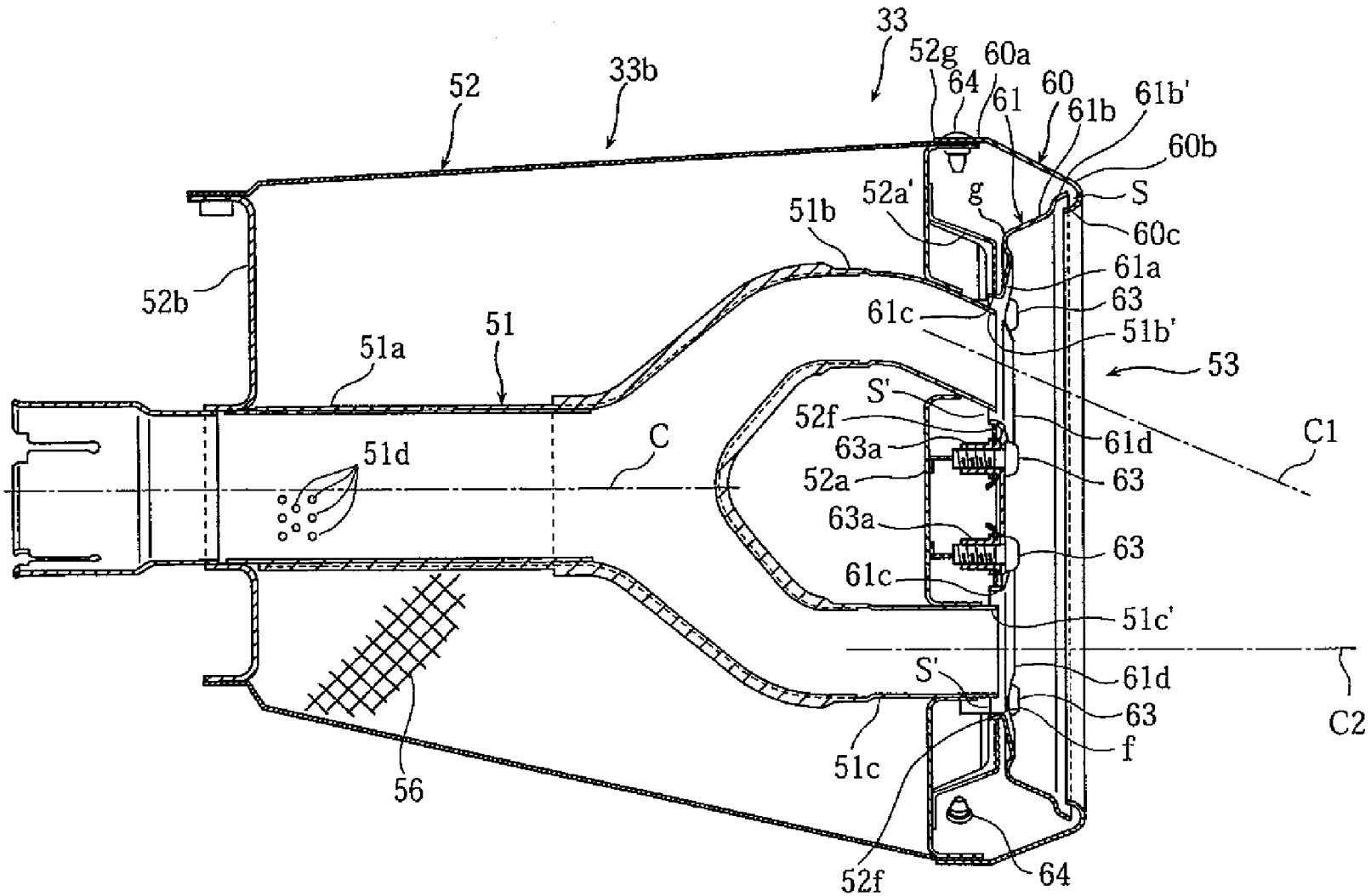
FIG. 10 is a cross sectional view of the muffler.
Figure 11:
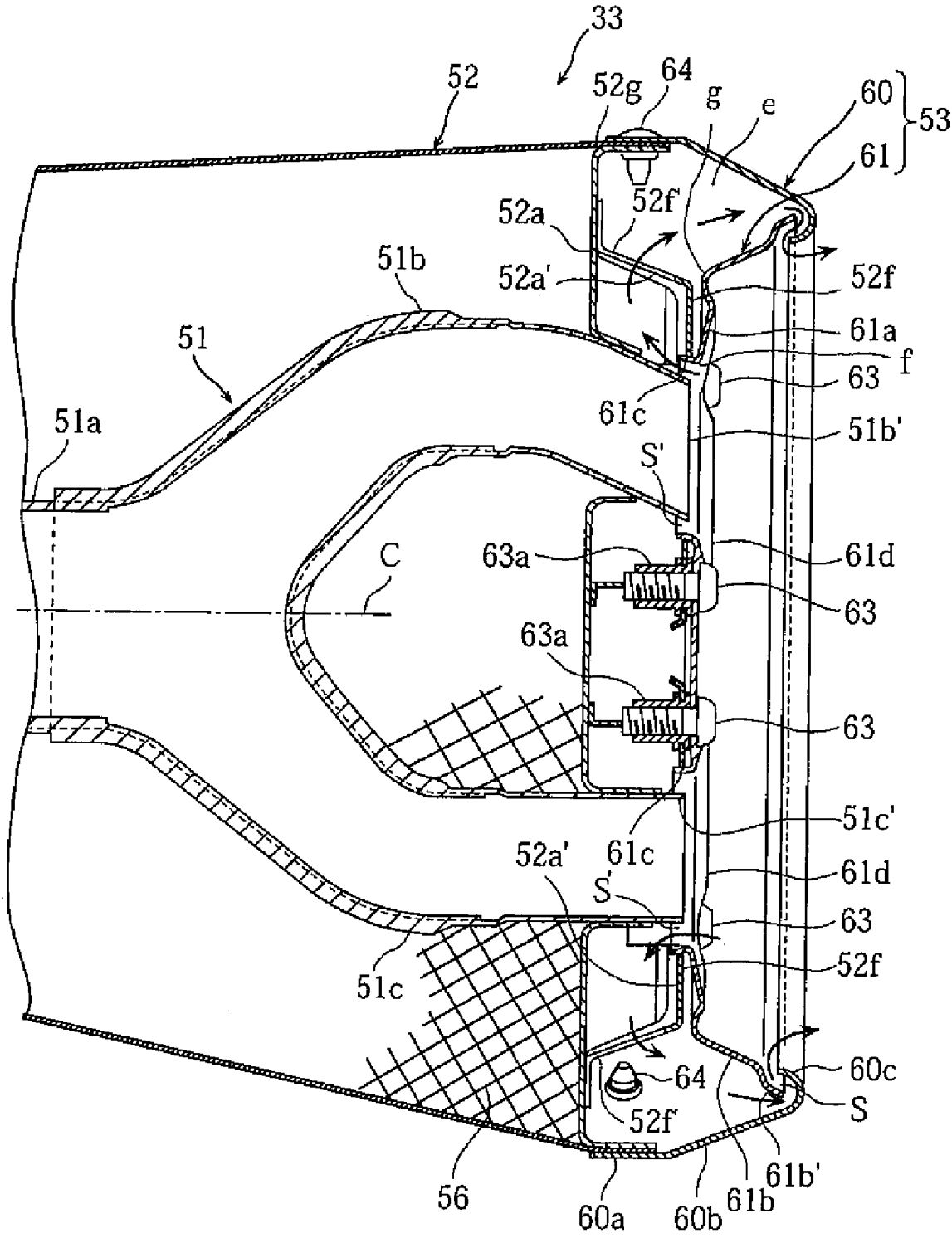
FIG. 11 is a cross sectional view of a tail cap of the muffler.
Figure 12:
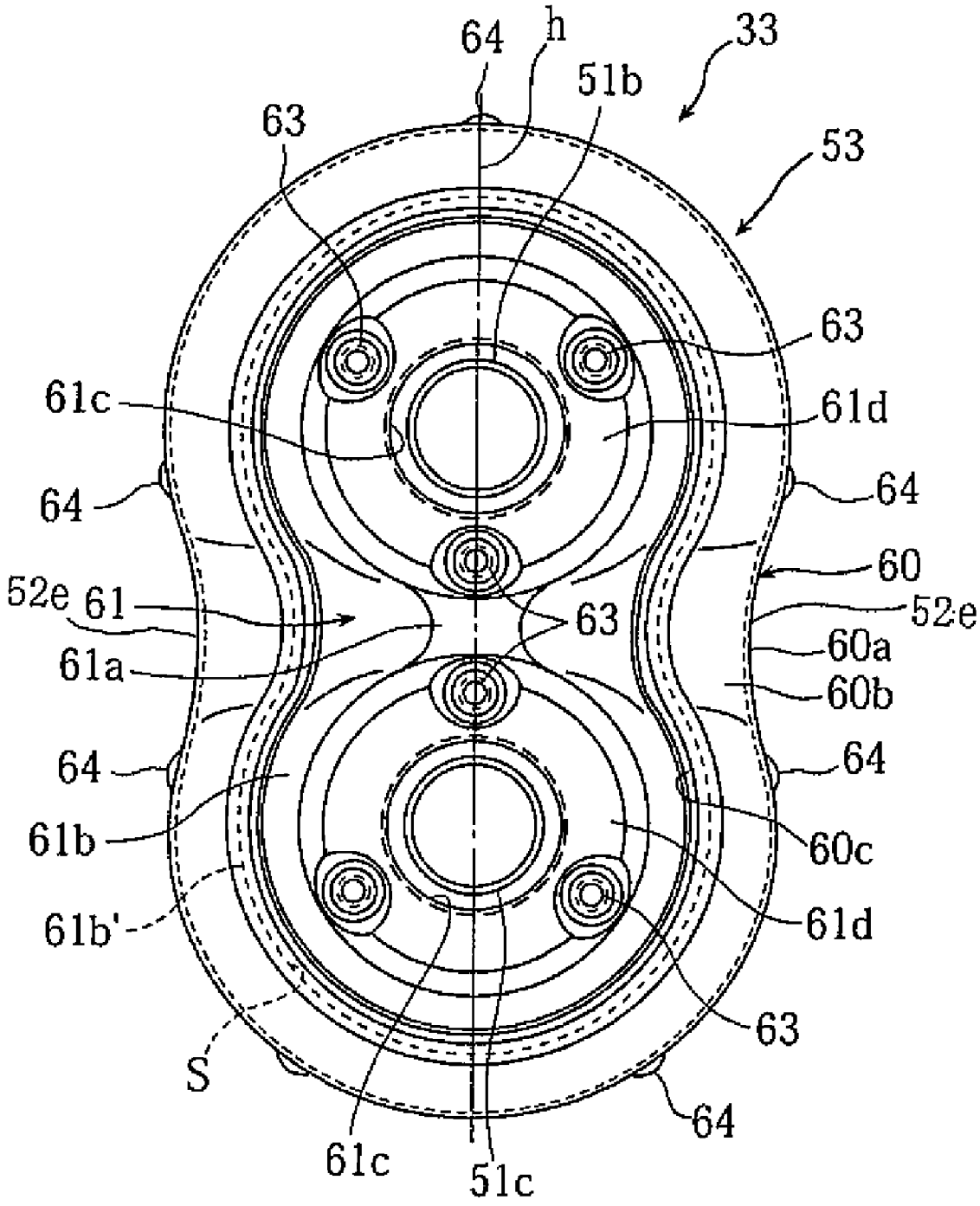
FIG. 12 is a rear view of the tail pipe.

As shown in FIGS. 10 and 11, second branch pipe 51*c* to the lower side is linear and has an axis line C2 that extends generally parallel with an axis line C of main pipe 51*a*. On the other hand, first branch pipe 51*b* to the upper side curves downward toward the second branch pipe 51*c* side. As a result, the exhaust pipe of first branch pipe 51*b* is slightly longer than second branch pipe 51*c*.

In addition, first branch pipe 51*b* is formed such that a rearward extension line of an axis line C1 thereof intersects with a rearward extension line of axis line C2 of second branch pipe 51*c*. Accordingly, when viewed when mufflers 33 are mounted, an exhaust port 51*c*' of second branch pipe 51*c* slopes upwards, while an exhaust port 51*b*' of first branch pipe 51*b* slopes relatively downwards.

An attachment bracket 52*d* is fixed to an upper wall surface of casing 52. Attachment bracket 52*d* is attached in an attachable-detachable manner to seat rails 2*c* via a stay member and the like.

A front end opening of casing 52 is closed by a front end wall 52*b*, and a rear end opening of casing 52 is closed by a rear end wall 52*a*. A pair of up-down brackets 52*a*' are fixed to rear end wall 52*a*. Each of brackets 52*a*' includes a cap attachment seat 52*f* that has a disc like shape when viewed from the vehicle rear direction, and a plurality of legs 52*f* that extend from attachment seat 52*f* toward rear end wall 52*a*. Legs 52*f* are fixed by welding to rear end wall 52*a*.

Exhaust ports (rear end surfaces) 51*b*', 51*c*' of first and second branch pipes 51*b*, 51*c* pass through rear end wall 52*a* and are disposed to form a generally flush surface with cap attachment seats 52*f*, 52*f* of brackets 52*a*' and an opening edge f of tail holes 61*c*. More specifically, exhaust ports 51*b*', 51*c*' of first and second branch pipes 51*b*, 51*c* are disposed to be slightly to the upstream side (the front side) than opening edge f of tail holes 61*c*, 61*c*.

Main pipe 51*a* passes through front end wall 52*b* to the front, and is joined to front end wall 52*b* in an air tight manner. First and second branch pipes 51*b*, 51*c* pass through rear end wall 52*a* to the rear, and are joined to rear end wall 52*a* in an air tight manner.

Casing 52 is an elliptically shaped cylinder that has an elliptical shape when viewed in a cross section, and a cross sectional area that increases from the upstream side to the downstream side when viewed from the exhaust gas flow direction. In addition, mufflers 33 incline diagonally upward to the vehicle rear such that a long axis h of the ellipsis extends generally in the upward-downward direction. Recessed portions 52*e*, 52*e* that are formed in a concave shape and that extend in the longitudinal direction (the flow direction of the exhaust gas) are provided in an upward-downward direction central portion of inner and outer side walls 52*c*, 52*c* of casing 52. As a result, casing 52 has a generally gourd like shape in which two circular sections partially overlap when viewed in a cross section.

An exterior cover 57 that covers the outer side of downstream side exhaust pipes 33*a* is provided between casing 52 and exhaust gas chamber 32. Exterior cover 57 is contiguous with casing 52 and has a pointed shape that becomes more pointed as exterior cover 57 extends toward the upstream side (the lower side), or, in other words, has a fan shape that widens to the downstream side. Exterior cover 57 forms a section of casing 52.

The inside of casing 52 is filled with a sound absorbing material 56, such as glass wool, such that tail pipes 51 are surrounded. A plurality of small holes 51*d* are formed around the entire periphery of main pipe 51*a*. A portion of the exhaust gas flows in to casing 52 through small holes 51*d*, and exhaust noise of the exhaust gas is absorbed by sound absorbing material 56.

Tail cap 53 is constructed by two parts, namely, an outer cap 60 and an inner cap 61. Outer cap 60 has a ring shape that surrounds a rear end edge 52*g* of casing 52. Inner cap 61 surrounds rear end wall 52*a* of casing 52.

Inner cap 61 includes a cap body 61*a* that surrounds rear end wall 52*a* of casing 52, and a flange 61*b* that protrudes from an outer periphery edge g of cap body 61*a* and extends outwards to the rear.

Tail holes 61*c*, 61*c*, which are provided as an upward and downward pair, are formed in cap body 61*a*. Each one of tail holes 61*c* has a larger diameter than exhaust ports 51*b*', 51*c*' of first and second branch pipes 51*b*, 51*c*, and a gap s' is formed between the outer periphery of branch pipes 51*b*, 51*c* and tail holes 61*c*.

A pair of upward and downward expanding sections 61*d*, 61*d* that have circular tail pipe-like shape protrude outward to the rear side in cap body 61*a*. Tail holes 61*c* are formed in a central section of expanding sections 61*d*.

Three bolts (fixing members) 63 are positioned at determined distances apart in the circumferential direction in an outer periphery of upward and downward expanding sections 61*d*. Inner cap 61 is fixed to brackets 52*a*' by screwing each bolt 63 to a nut 63*a* that is fixed to brackets 52*a*'. Accordingly, rear end wall 52*a* is covered by inner cap 61. In this manner, a disc shaped space e is formed between rear end wall 52*a* and tail cap 53 at the rear end section of casing 52.

Outer cap 60 includes a ring shaped section 60*a*, an inside slanting section 60*b*, and a bent back section 60*c*. Ring shaped section 60*a* extends along rear end edge 52*g* of casing 52. Inside slanting section 60*b* extends diagonally to the inside rear from ring shaped section 60*a*. Bent back section 60*c* curves and extends to the inside from inside slanting section 60*b*. Ring shaped section 60*a* is fixed to rear end edge 52*g* by rivets (fixing members) 64 that are disposed at determined distances apart in the circumferential direction.

Bent back section 60*c* bends around from the outside to the inside of an outer periphery edge 61*b*' of flange 61*b* of inner cap 61 so as to cover outer periphery edge 61*b*'. As a result, a gap s is formed at the boundary region between flange 61*b* and bent bank section 60*c*. Gap s and gap s' around branch pipes 51*b*, 51*c* communicate with space e surrounded by rear end wall 52*a* of casing 52 and outer cap 60 and inner cap 61.

According to the embodiment, tail pipe 51 has a structure in which first and second branch pipes 51*b*, 51*c* branch from main pipe 51*a*. Thus, the actual length of the tail pipe can be extended without extending the length of mufflers 33, thereby allowing the sound absorbing effect to be improved.

In addition, tail pipe 51 has main pipe 51*a*, and first and second branch pipes 51*b*, 51*c*, and is disposed inside casing 52 that is formed such that the cross sectional area thereof becomes larger to the downstream side (branch pipe side). Thus, the volume of the area between casing 52 and the section of branch pipes 51*b*, 51*c* can be increased as compared with a case where, for example, the casing is a straight pipe. As a result, to the extent that the area is larger, it is possible to ensure an adequate filled amount of sound absorbing material 56, whereby the sound absorbing effect is improved. Because the plurality of small holes 51*d* is formed in main pipe 51*a*, the sound absorbing effect is improved still further.

Moreover, the rear ends of first branch pipe 51*b* and second branch pipe 51*c* are disposed to the front side of the rear end of tail cap 53 that covers the rear end of casing 52 from the outer side. As a result, the rear end of the branch pipe does not protrude from the rear end of casing 52, and thus the external appearance is improved.

First branch pipe 51*b* and second branch pipe 51*c* are generally upward and downward from each other, and casing 52 has an elliptical shape when viewed in a cross section, and is disposed such that the long axis h of the ellipsis extends generally in the upward and downward direction. Accordingly, a design is created that conveys an impression of strength that has not been achieved before now.

Because exterior cover 57 that covers a section of engine side exhaust pipe 31 that is to the upstream side of casing 52 has a fan shape that widens to the downstream side, exterior cover 57 appears to form one section of casing 52. Thus, the impression of an external appearance in which mufflers 33 expand upward and downward as they extend to the downstream side is reinforced.

Since recessed portions 52*e* that extend in the flow direction of the exhaust gas are formed in the generally central section in the upward-downward direction of casing 52, an external appearance that the motorcycle has two protruding mufflers is created.

Since recessed portions 52*e* extend between first branch pipe 51*b* and second branch pipe 51*c*, an external appearance that the motorcycle has two protruding mufflers is reinforced and the impression that the two mufflers protrude to the side is strengthened.

Second branch pipe 51*c* is generally parallel with axis line C of main pipe 51*a*, and first branch pipe 51*b* bends diagonally downwards toward the second branch pipe 51*c* side, whereby axis lines C1, C2 of the two members intersect. Accordingly, exhaust gas discharged diagonally upwards to the rear of the vehicle from second branch pipe 51*c* collides with exhaust gas discharged relatively downwards from first branch pipe 51*b*, thus making it possible to inhibit the overall entirety of the exhaust gas from dispersing upward. Further, mufflers 33 can be disposed to incline upward to the rear of the vehicle while inhibiting exhaust gas from being discharged on to the section of the vehicle behind mufflers 33.

Because mufflers 33 are disposed such that the front-rear direction centres D thereof are disposed in the vicinity of front edge 5*b* of rear wheel 5, the center of mass of mufflers 33 is positioned toward the center of vehicle body frame 2. Thus, mass is concentrated in the vicinity of the front-rear direction centre of the vehicle.

Since left and right mufflers 33 are disposed to the front side of vertical line B that passes through centre x of rotating shaft 5*a* of rear wheel 5, an external appearance that conveys an impression of strength is created that has not been achieved before now. Moreover, the mass is concentrated.

This embodiment describes an example in which the exhaust gas chamber is interposed between the exhaust pipe and the muffler. However, the invention includes a structure in which the muffler is directly connected to the exhaust pipe.

The particular embodiments of the invention described in this document should be considered illustrative, rather than restrictive. Modification to the described embodiments may be made without departing from the spirit of the invention as defined by the following claims.

The invention claimed is:

1. A motorcycle comprising:

an engine;

an exhaust pipe, a head end thereof being connected to the engine, a rear section thereof including a main pipe, and first and second branch pipes connected to and branching from the main pipe towards a rear end of the exhaust pipe, the first branch pipe having a first exhaust port, the second branch pipe having a second exhaust port separate and distinct from the first exhaust port, the first and second branch pipes being formed such that respective axis lines thereof intersect when extended to a rear; and a muffler having a casing surrounding the rear section of the exhaust pipe, and sound absorbing material filled between the casing and the rear section of the exhaust pipe, wherein a cross sectional area of the casing, when viewed from an exhaust gas flow direction, increases as the casing extends toward the rear end of the exhaust pipe, so that the casing accommodates an increased amount of the sound absorbing material around the first and second branch pipes.

2. The motorcycle according to claim 1, wherein the exhaust pipe includes an engine side exhaust pipe that is connected to the engine, and a tail pipe that is connected to the engine side exhaust pipe and that is surrounded by the casing, and the tail pipe includes the first branch pipe and the second branch pipe.

3. The motorcycle according to claim 1, further comprising:

a tail cap that covers a rear end of the casing from an outer side, wherein rear ends of the first branch pipe and the second branch pipe are positioned to the front side of the rear end of the tail cap.

4. The motorcycle according to claim 1, wherein the main pipe has a plurality of small holes.

5. The motorcycle according to claim 2 wherein the first branch pipe and the second branch pipe of the tail pipe are disposed in positions that are generally upward and downward from each other.

6. The motorcycle according to claim 5, wherein the casing has, when viewed in a cross section, an ellipsis shape, and the casing is disposed such that a long axis of the ellipsis generally extends in an upward-downward direction.

7. The motorcycle according to claim 5, further comprising:

an exterior cover that surrounds a section of the engine side exhaust pipe that is to an upstream side of the casing, wherein the exterior cover has a fan shape that widens to a downstream side.

8. The motorcycle according to claim 6, wherein a recessed portion is formed in a generally upward-downward direction central section of the casing and extends in the exhaust gas flow direction.

9. The motorcycle according to claim 8, wherein the recessed portion extends between the first branch pipe and the second branch pipe.

10. The motorcycle according to claim 1, wherein the second branch pipe is generally parallel with the main pipe, and the first branch pipe curves toward the second branch pipe side, with the outlet ends of the first and second branch pipes being non-intersecting within the muffler.

11. The motorcycle according to claim 1, further comprising:

a rear wheel, wherein the muffler is disposed such that a front-rear direction centre of the muffler is disposed in the vicinity of a front edge of the rear wheel.

12. The motorcycle according to claim 1, further comprising:

a rear wheel, wherein the muffler is disposed to the front side of a vertical line that passes through a centre of a rotating shaft of the rear wheel.

13. The motorcycle of claim 1, wherein the cross sectional area of the casing is increased by non-radially expanding only portions of the casing positioned on an opposite side of the second branch pipe relative to the first branch pipe and positioned on an opposite side of the first branch pipe relative to the second branch pipe.

14. The motorcycle of claim 13, wherein the first and second branch pipes branch from the main pipe at a middle portion of the casing.

15. The motorcycle of claim 1, wherein the first and second branch pipes branch from the main pipe at a middle portion of the casing.

16. A motorcycle comprising:

an engine;

an exhaust pipe connected to the engine; and a muffler connected to the exhaust pipe, wherein the muffler includes a casing that surrounds a rear section of the exhaust pipe, and sound absorbing material that is filled between the casing and the rear section of the exhaust pipe, wherein the rear section of the exhaust pipe includes a main pipe that extends to the rear and a first branch pipe and a second branch pipe that are connected to and branch from a rear end of the main pipe and extend to the rear, the first and second branch pipes branching from the main pipe at a middle portion of the casing, the first branch pipe having a first exhaust port, the second branch pipe having a second exhaust port separate and distinct from the first exhaust port, the first and second branch pipes being formed such that respective axis lines thereof intersect when extended to the rear, a cross sectional area of the casing, when viewed from an exhaust gas flow direction, increases as the casing extends toward the branch pipe side, and the cross sectional area of the casing is increased by expanding only portions of the casing positioned on an opposite side of the second branch pipe relative to the first branch pipe and positioned on an opposite side of the first branch pipe relative to the second branch pipe, wherein the cross sectional area of the casing is not expanded between the first branch pipe and the second branch pipe.

17. The motorcycle of 16, wherein the second branch pipe is generally parallel with the main pipe, and the first branch pipe curves toward the second branch pipe side, with the outlet ends of the first and second branch pipes being non-intersecting within the muffler.

18. A motorcycle comprising:

an engine;

an exhaust pipe connected to the engine; and a muffler connected to the exhaust pipe, wherein the muffler includes a casing that surrounds a rear section of the exhaust pipe, and sound absorbing material that is filled between the casing and the rear section of the exhaust pipe, wherein the rear section of the exhaust pipe includes a main pipe that extends to the rear and a first branch pipe and a second branch pipe that are connected to and branch from a rear end of the main pipe and extend to the rear, the first and second branch pipes branching from the main pipe at a middle portion of the casing, the first branch pipe having a first exhaust port, the second branch pipe having a second exhaust port separate and distinct from the first exhaust port, the first and second branch pipes being formed such that respective axis lines thereof intersect when extended to the rear, a cross sectional area of the casing, when viewed from an exhaust gas flow direction, increases as the casing extends toward the branch pipe side, a plane intersecting the centerlines of the first branch pipe and the second branch pipe, and the cross sectional area of the casing is increased by expanding only end portions of the casing along the plane.

19. The motorcycle of 18, wherein the second branch pipe is generally parallel with the main pipe, and the first branch pipe curves toward the second branch pipe side, with the outlet ends of the first and second branch pipes being non-intersecting within the muffler.

* * * * *